United States Patent [19]

Nishino et al.

[11] 4,006,782

[45] Feb. 8, 1977

[54] TWO-WAY BULLDOZER MECHANISM

[75] Inventors: Shigeru Nishino; Tomio Uchida, both of Sagamihara, Japan

[73] Assignee: Caterpillar Mitsubishi Ltd., Tokyo, Japan

[22] Filed: Mar. 1, 1976

[21] Appl. No.: 662,487

[30] Foreign Application Priority Data

Apr. 4, 1975 Japan ..... 50-40442

[52] U.S. Cl. ..... 172/806

[51] Int. Cl.² ..... E02F 3/76

[58] Field of Search ..... 172/802, 806, 805, 801, 172/703, 735, 736, 739

[56] References Cited

UNITED STATES PATENTS

| | | | |
|---|---|---|---|
| 2,657,481 | 11/1953 | Larsen | 37/42 VL |
| 3,007,265 | 11/1961 | Harris | 172/802 |
| 3,853,181 | 12/1974 | Yoshizaki | 172/805 |

FOREIGN PATENTS OR APPLICATIONS

| | | | |
|---|---|---|---|
| 47-20503 | 6/1972 | Japan | 172/806 |
| 103,657 | 3/1964 | Norway | 172/806 |
| 224,377 | 11/1968 | U.S.S.R. | 172/802 |

*Primary Examiner*—Richard J. Johnson
*Attorney, Agent, or Firm*—John W. Grant

[57] ABSTRACT

A two-way bulldozer mechanism for mounting on an earthmoving vehicle includes an upper blade having an upper edge pivotally connected to the forward tip portions of a pair of push arms for pivotal movement thereabout and a lower blade hingedly connected to a lower edge of the upper blade for limited relative rotational movement to permit the attitude of the upper and lower blades to be adjusted to a first position suitable for forward bulldozing to a second position suitable for rearward dozing. A pair of levers have their intermediate portions pivotally connected to the push arms with each of the levers having its lower end pivotally connected to the lower blade and cooperates with the upper blade for controlling the attitude of the blades. A pair of hydraulic cylinders are mounted on the push arms with each hydraulic cylinder having an extensible and retractable piston rod pivotally connected to the upper end of one of the levers whereby extending the piston rods pivots the levers to position the lower and upper blades in the first position and retracting the piston rods pivots the levers to position the upper and lower blades in the second position.

9 Claims, 6 Drawing Figures

TWO-WAY BULLDOZER MECHANISM

BACKGROUND OF THE INVENTION

1. Field of the Invention:

This invention relates to a bulldozer blade for an earthmoving vehicle, and more particularly to improvements in the two-way bulldozer mechanism which is movable between a pushing mode and a pulling mode and provides an ample space under push arms above the ground.

2. Description of the Prior Art:

Two different prior art two-way bulldozer blade mechanisms which assume two operational modes are individually shown in FIGS. 1 and 2. For simplicity, only one side is shown and described in the following brief description of each mechanism.

FIG. 1 shows a prior art bulldozer mechanism having upper and lower blades which are hinged together, with the lower blade *a* pivotally connected to a push arm *c* by means of a pin *d*. The upper blade *b* is connected through the medium of a brace *g* to the push arm *c* by means of pins *e*,*f*. A pair of levers *k* are formed on the opposite edges of the lower blade *a*, while a bifurcated bracket is formed on the top surface of the push arms *c*, with a hydraulic cylinder *j* interconnected between the lever *k* and the aforesaid bracket by means of pins *h*, *i*. Thus, the blades give a bend at a hinge point due to the extension and retraction of the cylinder, thereby switching from a pushing mode shown by a solid line to an opposite pulling mode shown by a broken line, and vice versa.

FIG. 2 shows another type bulldozer mechanism presenting a single blade type. The blade *a* is provided with suitable curvatures on the opposite surfaces thereof, with a connecting lever *k* secured to the upper portion of the blade *a*. The tip portion of a push arm *c* is pivotally connected to the lever *k* by means of a pin *d*. A hydraulic cylinder *j* is interconnected between the lever *k* and the push arm *c* by means of pins *h* and *i*, which are positioned on the sides of lever *k* and push arm *c*, respectively. The blade *a* switches from a pulling mode shown by solid line to a pushing mode shown by a two point chain line, and vice versa, according to the extension and retraction of a hydraulic cylinder.

Now, the merits and demerits of the aforesaid prior art bulldozer mechanisms will be described hereunder.

The split-type blade assembly as shown in FIG. 1 provides an advantage in that the blade assembly allows the selection of a blade configuration suited for a desired cutting angle, and a trimming or bending angle of mold boards, as required. On the other hand, the aforesaid blade mechanism suffers from a shortcoming in that, since a pivot connection *d* is positioned in the rear but below the lower blade so as to allow the pivotal movement of the lower blade in the connection *d*, the attaching position of the push arm is lowered, resulting in interference between materials being removed and the undersurface of the push arm or the undersurface of a cross member interconnecting a pair of push arms, during the trimming operation, whereby the piercing of a blade edge is hindered. To cope with the aforesaid shortcomings, it may be a solution to this problem to provide a push arm, whose attaching portion to the lower blade is bent upwardly so as to give an arch shaped portion. However, such a formation is necessarily subjected to a design limitation and offers many problems arising from the manufacture and rigidity of the push arm.

The bulldozer blade mechanism as shown in FIG. 2 is simple in construction as compared with the blade mechanism of FIG. 1, because of the use of a single blade, and presents an advantage of a wide space under the push arms as well as an excellent piercing capability of the blade, because the attaching positions of the push arms are located in the upper portion of the blade. However, a single blade type mechanism of FIG. 2 fails to provide such desired curvatures as defined by the moldboards of the mechanism of FIG. 1 as well as the cutting angle of the blade edge as provided by the latter. To overcome this shortcoming, the width of the blade may be increased as shown by a one point chain line in FIG. 2, with a resulting increase in weight of the blade itself. In addition, during the unloading operation within a hold of a ship, the outwardly or forwardly projecting portion of the blade interferes with a wall or pole of the hold.

Meanwhile, it is generally accepted principle for a tractor that a bending angle of moldboards should be increased for reducing a load to be imposed on blades as well as for facilitating a bulldozing action of blades in both the forward and rearward directions of movement of a tractor. The blade mechanism of FIG. 2 sacrifices these desired cutting angle and bending angle of moldboards, because of the use of a single blade.

SUMMARY OF THE INVENTION

The present invention is directed to avoiding the aforesaid shortcomings experienced with the prior art bulldozer blade mechanisms by providing a novel two-way bulldozer mechanism.

An object of the present invention is to provide an improved two-way bulldozer mechanism which allows a smooth change in the trimming angles of the upper and lower blades in the forward and rearward directions of movement of a vehicle by suitably providing several pivot connections for linking means of blades, with the aid of hydraulic cylinders.

Another object of the present invention is to provide an improved two-way bulldozer mechanism which provides an increased height or space as measured from the ground to the undersurfaces of push arms, cross members and the like, thereby improving the piercing capability of the lower edge of the lower blade as well as minimizing the interference of push arms and cross members with material being removed by the blade mechanism in pulling mode of the operation, the above described advantages accruing from the fact that the tip portions of the push arms are attached to the upper edge of the upper blade.

Another object of the present invention is to provide a two-way bulldozer mechanism, in which the moldboards defining the surfaces of the upper and lower blades provide a smooth continuous surface, when the bulldozing or operational angle of the blades is changed from that of a pulling mode to that of a pushing mode, and vice versa.

Another object of the present invention is to provide a two-way bulldozer mechanism, which is simple in construction by eliminating the use of an upper brace which has been considered to be essential for a split-type blade mechanism, thereby reducing the manufacture cost of the blades.

Another object of the present invention is to provide a two-way bulldozer mechanism which permits a desired design change for the height and width of the blades according to the aforesaid simple construction of the blade mechanism.

According to the present invention, there is provided a two-way bulldozer mechanism of the type, which includes a pair of elongated push arms with each push arm having a forward tip portion provided thereon, an upper blade having an upper edge pivotally connected to the forward tip portions of the push arms for pivotal movement thereabout, a lower blade hingedly connected to a lower edge of the upper blade for limited relative rotational movement to permit the attitude of the upper and lower blades to be adjusted from a first position suitable for forward bulldozing to a second position suitable for rearward bulldozing, a pair of lever means individually pivotally connected at their intermediate portions to the push arms, each of said lever means having its lower end pivotally connected to the lower blade, the lever means cooperating with the upper blade for controlling the attitude of the blades, and a pair of hydraulic cylinders mounted on the push arms, each hydraulic cylinder having an extensible and retractable piston rod pivotally connected to an upper end of one of the lever means whereby extending the piston rods pivots the lever means to position the lower and upper blades in said first position and retracting the piston rods pivots the lever means to position the lower and upper blades in said second position.

BRIEF DESCRIPTION OF THE DRAWINGS

FIG. 6 is a schematic side elevational view, partly shown in cross section, of the two-way bulldozer mechanism according to the invention.

DESCRIPTION OF THE PREFERRED EMBODIMENT

Figure 3:
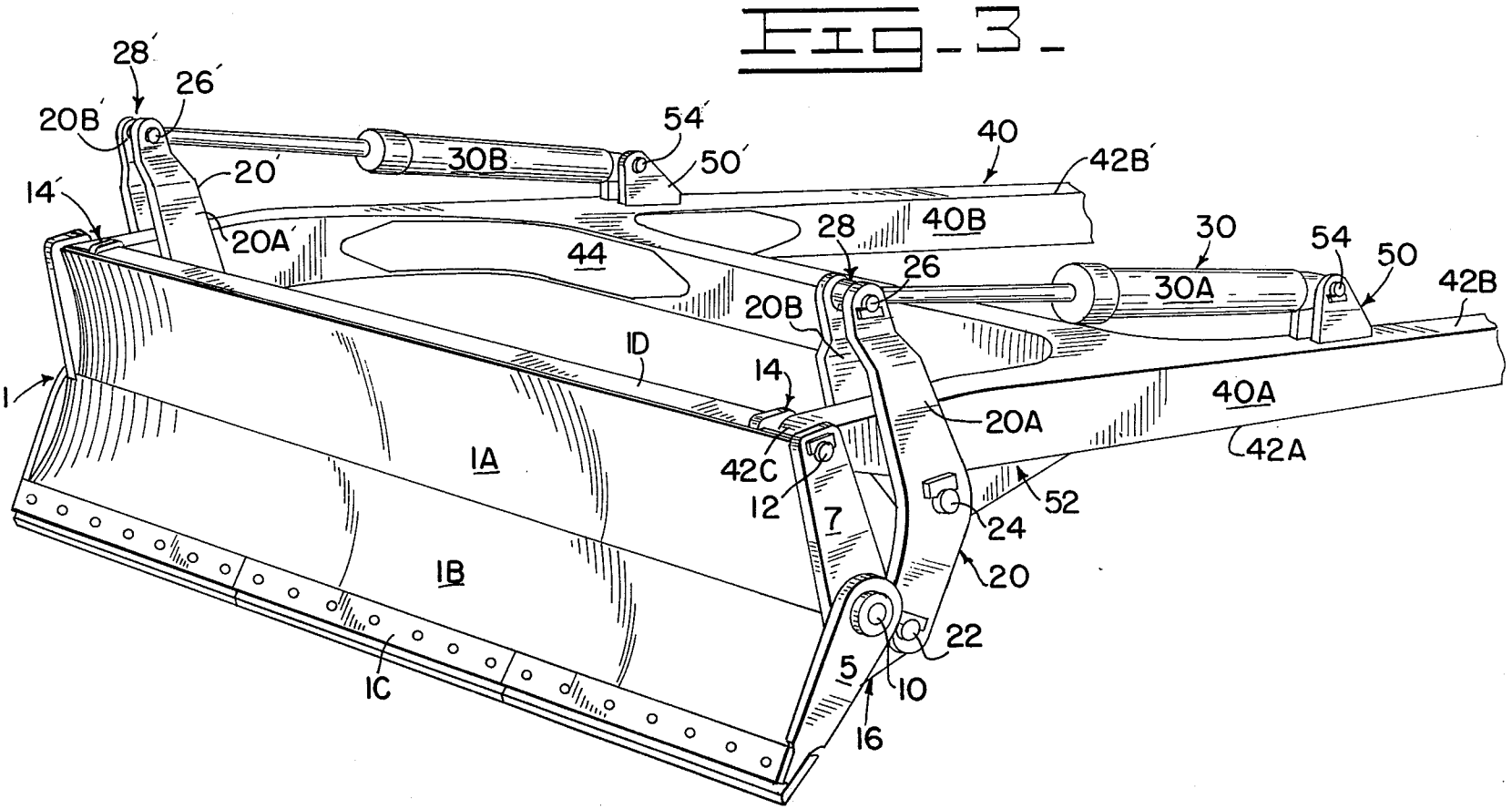
FIG. 3 is a front perspective view of the two-way bulldozer mechanism according to the present invention.
Figure 4:
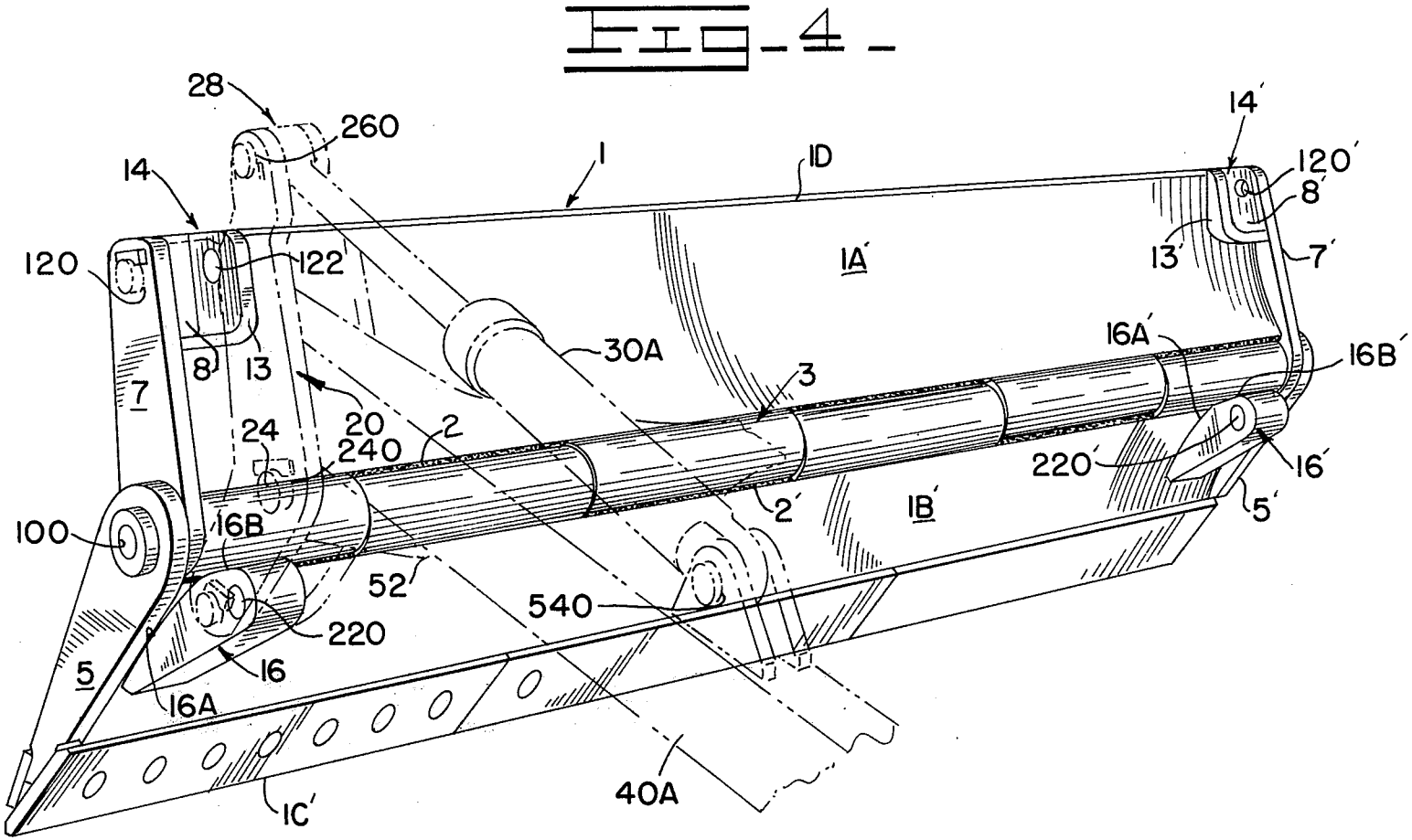
FIG. 4 is a rear perspective view of the two-way bulldozer mechanism of FIG. 3.

Referring now to FIGS. 3 and 4, the blade assembly of a two-way bulldozer mechanism embodying the principles of the present invention is generally indicated at 1 for mounting at the front end of an earthmoving vehicle, not shown. The blade assembly 1 consists of an upper blade 1A and a lower blade 1B, the opposite surfaces of which are each defined by a pair of moldboards. As best shown in FIG. 4, the upper blade 1A is pivotally connected to the lower blade 1B by means of a plurality of tubular hinges or pivot means 3, and a pin 10 extending through the pivot means 3 all the way therethrough. The pin 10 is rotatably supported by a pair of circular end plates 4 (FIG. 6) having pin bosses thereon. The pivot means 3 consists of a plurality of tubular members which are alternately joined to the edges of the upper blade 1A and the lower blade 1B, such as by welding. The above referred construction of the upper and lower blades are described in more detail in the specification of the U.S. Pat. application No. 600,748, filed on July 30, 1975 and assigned to the assignee of the present application.

The upper and lower blades 1A, 1B may assume a pulling mode and a pushing mode by changing an angle formed thereby, and thus the attitude of the blades, presenting a smooth and continuously curved surface defined by a pair of moldboards.

Shown at 2,2' in FIG. 4 are weld beads of the blades 1A, 1B connected to the pivot means 3.

Side boards 7,7' are secured to the opposite sides of the upper blade 1A, and side boards 5,5' are secured to the opposite sides of the lower blade 1B, as shown in FIG. 4. The side boards 7,7' are sandwiched between the side boards 5,5' in a rotatable manner relative to the latter. A bore 100 for the hinge pin 10 extends between the side boards 5,5' through the boards 7,7' and pivot means 3 in coaxial relation. A cutting edge 1C is secured to the lower edge of the lower blade 1B according to a suitable means. An elongated upper board 1D (FIG. 3) is attached to the upper edge of the upper blade 1A. The upper board 1D terminates a short distance before the upper side boards 7,7'.

As best shown in FIG. 4, sockets 8,8' of a square shape are defined in the top opposite edges of a back surface 1A' of the upper blade 1A, with the sockets bounded by 'L' shaped or inverted 'L' shaped small pieces 13,13', which are in turn welded to the upper blade 1A, surface 1A', side boards 7,7' and upper board 1D, respectively, thereby providing bearing means 14,14' or the first pivot connection. It should be noted however that the way to form the aforesaid sockets 8,8' should not necessarily be limited to the above instance. As an alternative, although not shown, bifurcate brackets may be provided on the top, sidewise opposite edges of the upper blade by a suitable means such as welding, respectively. A tip portion 42C of a push arm 40 as shown in FIG. 3 is pivotally supported in the bearing means 14,14', being positioned in sockets 8,8' defined by the bearing means 14,14'. Bores 120,122 (FIG. 4) are defined in the bearing means 14,14' so as to support a hinge pin 12 therein for the pivotal connection with the tip portion 42C of the push arm 40. In this manner, the upper blade is pivoted to the push arm 40 by means of the hinge pin 12. The dimensions of the small pieces 13,13' are so determined as to prevent their interference with the lower surface 42A (FIG. 3) of the push arm 40, when the push arm 40 is pivotally moved downwards. The description of the bearing means on the other side is omitted, because of complete duplication.

Brackets 16,16' (FIG. 4) are secured to the back surface 1B' of the lower blade 1B on the upper opposite edges thereof. The bracket 16,16' serve as bearing portions to be described later and include bottom surfaces 16A,16A' (FIG. 4) extending upwards slantwise. As is clear from the foregoing, brackets 16,16' are located below the first pivot connection 14,14'. The bottom surfaces 16A,16A' of the brackets should be so designed as to match with the surface of the moldboard 1B to give satisfactory welds therebetween. Upper surfaces 16B,16B' of the brackets 16,16' should be so designed as to prevent their interference with the pivot means 3 of the blade assembly 1, when the blades are pivotally moved about the pivot means 3.

Defined in the bearing means 16,16' are pin bores 220,220', through which pins 22 extend, thereby providing the pivotal connections of the lower ends of link means or levers 20,20' with brackets 16,16', respectively. This pivot connection is referred to as the fifth pivot connection. The push arms generally depicted at 40 in FIG. 3 include a pair of push arms 40A,40B pivotally connected by the medium of trunnions to a track frame secured to the opposite sides of a tractor not shown. The other ends or tip portions of the push arms are pivotally connected to the bearing portions 14,14', at the first pivot connection, as has been described earlier. A cross member 44 (FIG. 3) spans the space between the pair of push arms 40A,40B for reinforcement.

As shown in FIG. 3, brackets 50,50' of a triangular shape are mounted on the top surfaces of the push arms 40A,40B, respectively, and pivotally support the cap ends of a pair of hydraulic cylinders 30A,30B therein by means of hinge pins 54,54'. Shown at 540 is a pin bore defined in the bracket 50.

One of the third pivot connections on the side of the push arm 40B can not be shown, and thus description will be limited to that on the side of the push arm 40A. A triangular bracket 52 serving as a bearing means is secured to the undersurface 42A of the push arm 40A in the position close to its tip portion. The bracket 52 is formed with a pin bore 240 shown by a phantom line in FIG. 4, through which a hinge pin 24 extends. Thus, the lever or link means 20 is pivotally supported in the bearing means 52 i.e., at the third pivot connection, by means of the pin 24. More specifically, the link means 20,20' are formed by two pairs of plates 20A,20B, and 20A',20B', of a bell crank shape, with each pair of plates sandwiching the respective push arms 40A,40B, on the opposite sides of the push arms, respectively. Provided in the upper portions of the link means 20,20' are the fourth pivot connection 28,28' in which the rod end of the hydraulic cylinder 30A is pivotally connected to the upper tip of the link means 20 by a hinge pin 26. The shape of the link means 20,20' are so designed as to bend forwardly as well as to maintain a desired height for the fourth pivot connection. Designated 26' and 28' are a hinge pin and the fourth pivot connection of the other link means, respectively. The lower half of the link means 20 is bent forwardly and pivotally connected to the bearing portion 16 by means of the hinge pin 22, as has been described earlier. Stated otherwise, the link means 20 has a suitable length for the pivotal movement of the blade 1 as well as for the extension and retraction of a cylinder rod of the hydraulic cylinder 30A, and is of a shape suitable for transmitting the force of the hydraulic cylinder 30A to the lower blade 1B. It should be noted however that the position of the bearing means 52, serving as the third pivot connection, for the pivotal movement of the link means 20,20' should not necessarily be limited to the undersurface 42A of the push arm 40A. Although not shown, the third pivot connection may be positioned directly on the push arm 40A itself, or on the top surface thereof, alternatively.

OPERATION OF THE PREFERRED EMBODIMENT

While the operation of the present invention is believed apparent from the foregoing description, further detailed description will be given of the ensuing brief summary of such operations.

Figure 5:
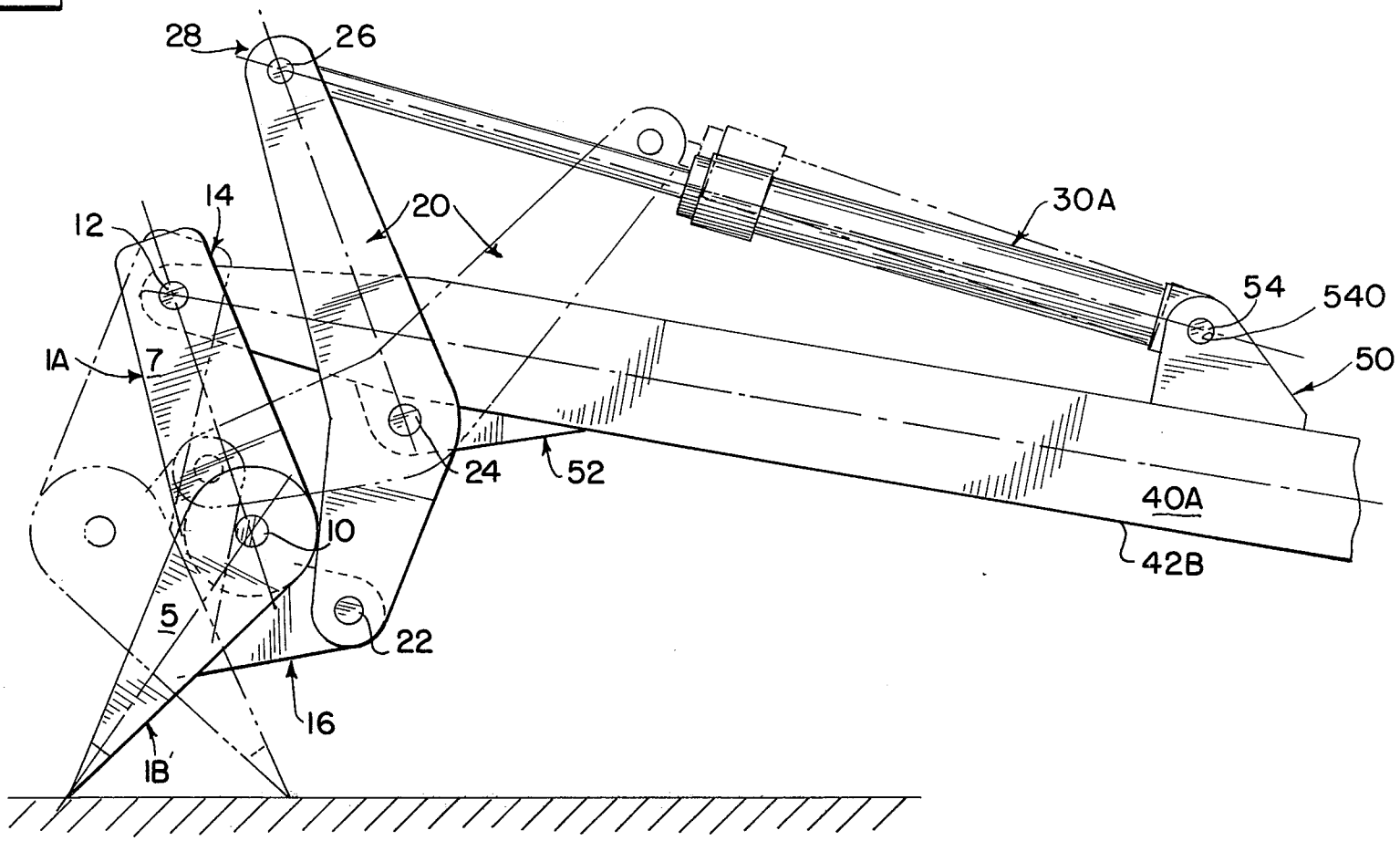
FIG. 5 is a schematic side elevational view of the two-way bulldozer mechanism according to the present invention.
Figure 5:
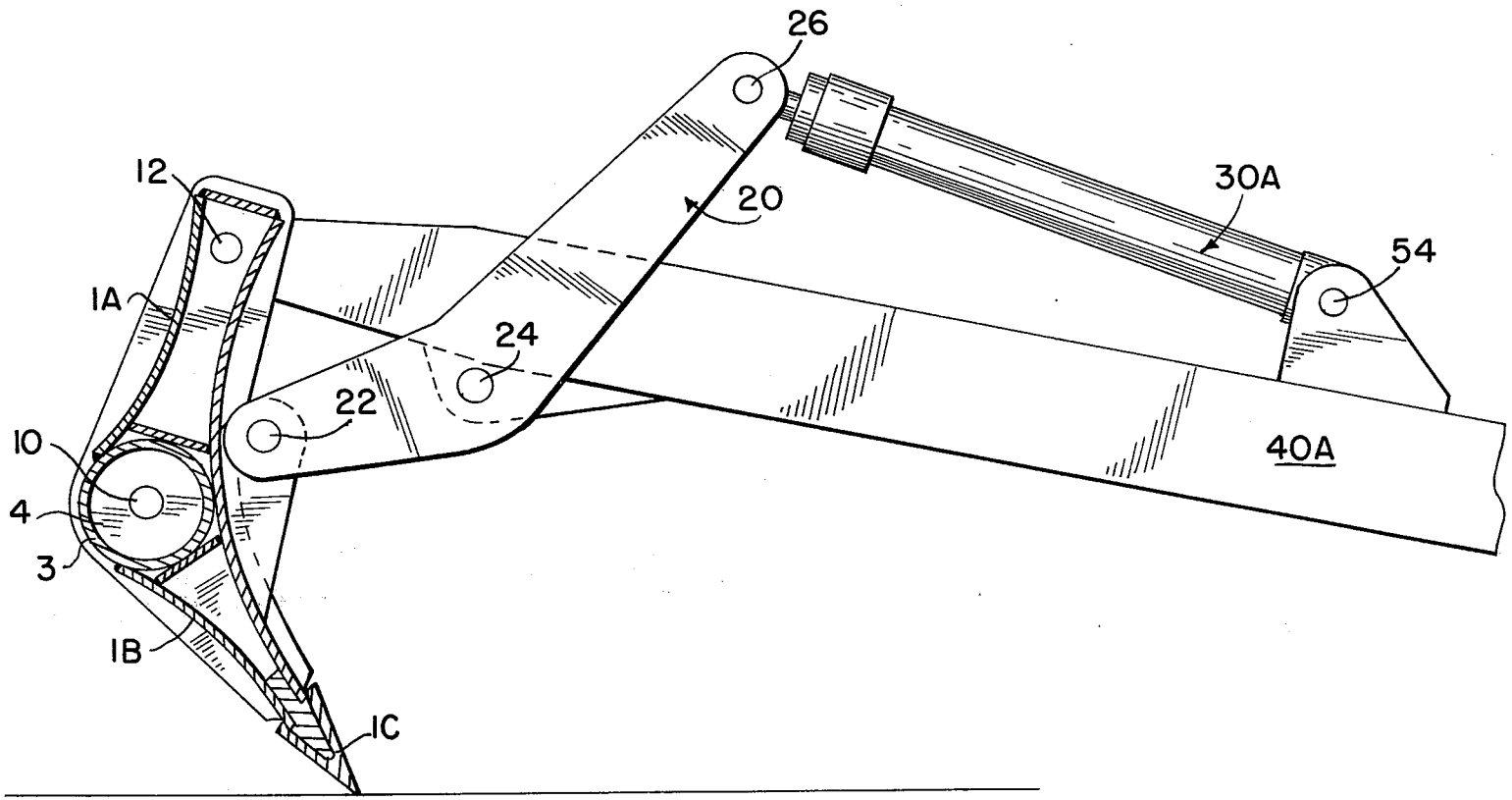

FIGS. 3 and 5 show the piston rods of the hydraulic cylinders 30A,30B maximum extended stroke so that the blade assembly 1 assumes an attitude most suitable for the forward dozing or pushing mode.

If the hydraulic cylinders 30A,30B are retracted from this attitude to the minimum stroke of the piston rods, then the upper ends of the link means 20,20' (the fourth pivot connection) will be pivotally moved forwards about the pins 24,24' (the third pivot connection), respectively.

At this time, the second pivot connection between the upper blade 1A and the lower blade 1B is moved forwards, because the lower end of the link means 20,20' push the lower blade 1B forwards through the medium of brackets 16,16', due to the pivotal movement of the link means 20,20'. However, referring only to the upper and lower blades 1A,1B, the upper blade 1A effects the pivotal movement about the second pivot connection 3 rearwards, thereby assuming a rearward dozing or pulling mode as shown in FIG. 6. In this manner, the force of the hydraulic cylinder is transmitted through the link means and lower blade to the upper blade, thereby allowing a change from a pushing mode to a pulling mode. It should be recognized herein that the tip portions of the push arms spanned by the cross member are pivotally connected to the upper edge of the upper blade 1A, while offering no interference with other members, enabling the provision of a flat rigid frame construction of push arms and a cross member. The push arms may be pivotally moved up and down due to the extension and retraction of another hydraulic cylinder, not shown. (This is usually positioned between an engine enclosure of a tractor and the cross member 44.) The extent of the upward pivotal movement of the push arm is greater than that of the bulldozer of the type shown in FIG. 1, so that there may be provided an ample space between the push arms and the ground or materials being removed, because of the aforesaid provisions of the push arms 40 attached to the upper edge of the upper blade 1A. In addition, as has been described earlier, the brackets 16 in the fifth pivot connection are directed upwards and pivotally moved in the direction of approach to the upper blade 1A, thereby increasing an effective operational space of the lower blade 1B on its back side, as well as facilitating the piercing of the lower blade 1B.

Figure 1:
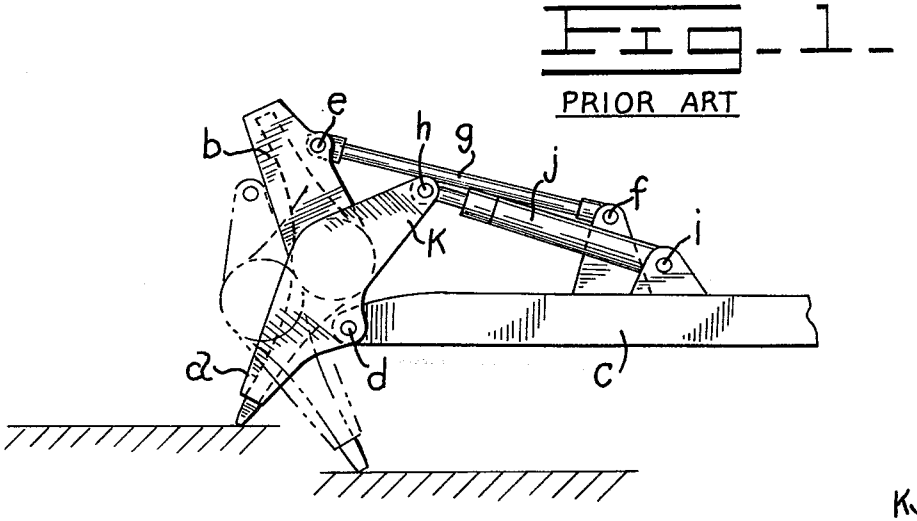
FIG-1- PRIOR ART
FIGS. 1 and 2 are side elevational views of two different prior art two-way bulldozer blade mechanisms, in which a split type blade mechanism and a single blade type mechanism are shown, respectively.

With the blade mechanism shown in FIG. 1, the levers *k* integral with the lower blade are pivotally moved forwards and rearwards, upon bulldozing of the blade mechanism, so that the levers should be positioned on the opposite sides of the blade. In addition, the push arms should also be attached to the opposite sides of the lower blade, in line with the positions of the levers *k* and the hydraulic cylinders, so that if an attempt is made so as to increase the width of the blade by using a material light in weight, the attaching portion of the push arm to the lower blade should be diverged. Such an arrangement is undesirable from the viewpoints of mounting of cylinders and rigidity of push arms.

In contrast thereto, according to the blade mechanism of the invention, the link means 20 serving as a lever is separated from the blades, while the push arms 40 may be attached to the upper, central edge of the upper blade 1A or to the upper, sidewise opposite edges of the rear surface of the blade 1A. As a result, the pivot connection between the push arms and the upper blade may be located in a desired position close to the aforesaid upper central edge of the upper, sidewise opposite edges of the rear surface of the upper blade 1A. This facilitates the design of a blade mechanism for bulldozing chips or corns, by using a light weight material for blades, as well as allows mounting of a blade mechanism of the invention on an inside arm type tractor. Meanwhile, in the case of the application of the blade mechanism according to the present invention to an inside arm type tractor, a limitation arises on the attaching positions of pushing arms, because the attaching portion of push arms to the side of the body of a tractor are placed between a tractor and a track roller frame.

Figure 2:
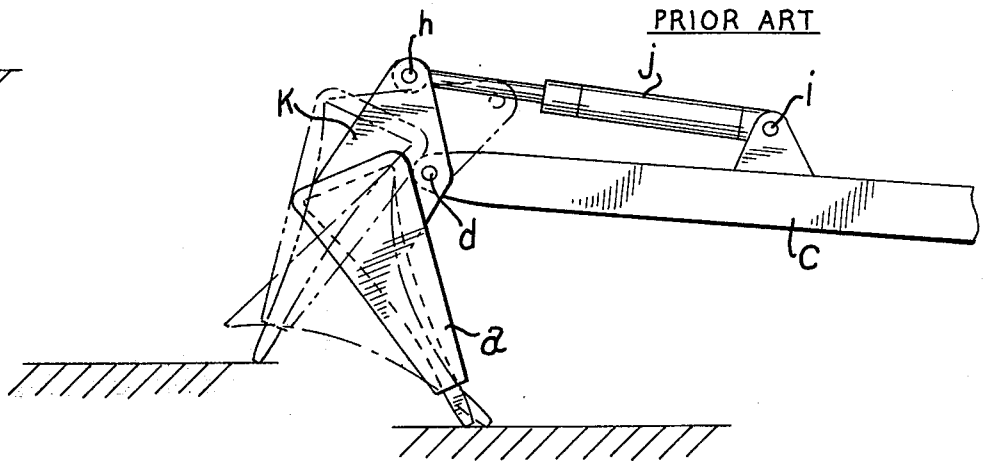
FIG-2- PRIOR ART

According to the present invention, the link means 20 supports the lower blade 1B, while the upper blade is supported by means of the push arm 40, respectively. This dispenses with the use of a brace *g* as shown in FIG. 1. An increase of the height of push arms being attached to the upper edge of the upper blade alleviates a possibility of the hydraulic cylinder 30 contacting materials being removed, because of the hydraulic cylinder 30 being positioned on the upper surface 42B of the push arm 40A. In connection with this, the prior art two-way bulldozer blade mechanism essentially uses guard means for hydraulic cylinders. However, the blade mechanism according to the present invention may be devoid of such guard means or may simplify the construction of such guard means. Unlike the prior art blade mechanism as shown in FIG. 2, the blade mechanism according to the present invention insures a desired cutting angle of a lower blade and a bending or trimming angle of moldboards, thus presenting excellent bulldozing performances. Yet furthermore, the attaching positions of the push arms 40 may be placed on the upper edge of the lever of the prior art blade mechanism as shown in FIG. 2, so that the size and width of the blades may be increased for enhancing the bulldozing capability, with the result of a possibility of a wide range of its application such as to the bulldozing of light materials (corns and the like), in addition to its inherent applications to civil engineering and bulldozing of a hard material (such as iron ore, rock salt).

Still furthermore, the two-way bulldozer mechanism according to the present invention may be simplified in construction and provides ease in manufacture, with a resulting reduction in manufacture cost.

Lastly, unlike the prior art two-way bulldozer, in which the attitudes of blades are controlled directly by means of hydraulic cylinders, the blade mechanism according to the present invention controls the attitudes of the blades indirectly, i.e., through the medium of link means 20, so that loads to be imposed on hydraulic cylinders may be alleviated to a great extent.

While the invention has been described and shown with particular reference to the preferred embodiments, it will be apparent that variations and alterations might be possible that would fall within the scope and preview of the present invention which is not intended to be unduly limited except as defined in the following claims.

What is claimed is:

1. A two-way bulldozer mechanism comprising:

a pair of elongated push arms with each push arm having a forward tip portion provided thereon;

an upper blade having an upper edge pivotally connected to the forward tip portions of the push arms for pivotal movement thereabout;

a lower blade hingedly connected to a lower edge of the upper blade for limited relative rotational movement to permit the attitude of the upper and lower blades to be adjusted from a first position suitable for forward bulldozing to a second position suitable for reverse bulldozing;

a pair of lever means individually pivotally connected at their intermediate portions to the push arms, each of said lever means having its lower end pivotally connected to the lower blade, the lever means cooperating with the upper blade for controlling the attitude of the blades; and a pair of hydraulic cylinders mounted on the push arms, each hydraulic cylinder having an extensible and retractable piston rod pivotally connected to an upper end of one of the lever means whereby extending the piston rods pivots the lever means to position the lower and upper blades in said first position and retracting the piston rods pivots the lever means to position the lower and upper blades in said second position.

2. The two-way bulldozer mechanism as set forth in claim 1 including first bracket means mounted on said push arms with said lever means being pivotally connected thereto and second bracket means secured to the rear surface of said lower blade with the lower ends of the lever means being pivotally connected thereto.

3. The two-way bulldozer mechanism as set forth in claim 2 wherein said first bracket means are mounted on an undersurface of said push arms.

4. The two-way bulldozer mechanism as set forth in claim 2 wherein said second bracket means has a rearwardly disposed surface extending upwardly slantwise to the pivotal connection with the lower end of the pair of lever means when said upper and lower blades are in said second position.

5. The two-way bulldozer mechanism as set forth in claim 1 including means forming a pair of sockets at the upper opposite ends of the upper blade for pivotally receiving the tip portions of the push arms therein.

6. The two-way bulldozer mechanism as set forth in claim 5 including bracket means secured to the upper edge of the upper blade for forming the sockets.

7. The two-way bulldozer mechanism as set forth in claim 1 wherein said pair of hydraulic cylinders are individually mounted on the top surfaces of said pair of push arms.

8. The two-way bulldozer mechanism as set forth in claim 1 wherein each pair of lever means includes a pair of opposing plates which sandwich a respective push arm therebetween.

9. The two-way bulldozer mechanism as set forth in claim 1 wherein said pair of lever means is a pair of bell cranks, each having its apex pivotally connected to the respective push arm and its upper and lower portions tilted forwardly when the piston rod of the hydraulic jacks are extended.

* * * * *